US011378261B2

(12) United States Patent
Lin et al.

(10) Patent No.: US 11,378,261 B2
(45) Date of Patent: Jul. 5, 2022

(54) LINEAR LIGHT APPARATUS

(71) Applicant: XIAMEN LEEDARSON LIGHTING CO., LTD, Fujian (CN)

(72) Inventors: Junjie Lin, Fujian (CN); Shaomei Liang, Fujian (CN); Lei Zhang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/334,412

(22) Filed: May 28, 2021

(65) Prior Publication Data

US 2021/0372598 A1 Dec. 2, 2021

(30) Foreign Application Priority Data

May 28, 2020 (CN) ..... 202010467421.0
May 28, 2020 (CN) ..... 202010467617.X

(51) Int. Cl.

| | |
|---|---|
| ***F21V 19/00*** | (2006.01) |
| ***F21S 4/28*** | (2016.01) |
| ***F21Y 115/10*** | (2016.01) |
| ***F21Y 103/00*** | (2016.01) |
| ***F21V 17/16*** | (2006.01) |

(52) U.S. Cl.

CPC ..... *F21V 19/004* (2013.01); *F21S 4/28* (2016.01); *F21V 19/0015* (2013.01); *F21V 17/164* (2013.01); *F21Y 2103/00* (2013.01); *F21Y 2115/10* (2016.08)

(58) Field of Classification Search

CPC .... F21V 19/0015; F21V 19/004; F21V 25/00; F21V 17/164; F21S 4/28; F21Y 2103/00; F21Y 2115/10

See application file for complete search history.

(56) References Cited

U.S. PATENT DOCUMENTS

| | | | | |
|---|---|---|---|---|
| 7,160,006 | B1 * | 1/2007 | Horner | F21V 17/164 24/561 |
| 10,982,839 | B1 * | 4/2021 | Yang | F21V 15/01 |
| 2011/0261566 | A1 * | 10/2011 | Boulton | F21V 19/0015 362/249.02 |
| 2011/0286207 | A1 * | 11/2011 | Chan | F21V 15/013 362/217.1 |
| 2013/0039054 | A1 * | 2/2013 | Yang | F21V 29/83 362/244 |
| 2014/0009942 | A1 * | 1/2014 | Kramer | F21S 4/28 362/296.07 |
| 2015/0003053 | A1 * | 1/2015 | Ariyoshi | F21K 9/27 362/223 |
| 2016/0327237 | A1 * | 11/2016 | Hoch | F21S 8/00 |
| 2021/0215332 | A1 * | 7/2021 | Scarlata | F21V 29/763 |

* cited by examiner

*Primary Examiner* — Tsion Tumebo
(74) *Attorney, Agent, or Firm* — Chun-Ming Shih; Lanway IPR Services

(57) ABSTRACT

A linear light apparatus includes a light strip, a light passing cover, a main bracket, a bottom holder and a metal clip. The light strip having an elongated substrate mounted with LED modules. The main bracket holds the light strip for the LED modules emitting a light passing through the light passing cover. The metal clip has a first thorn and a second thorn. The metal clip is pressed to one side wall for the first thorn to stab a second insulation layer to electrically connect the bottom holder and the metal clip. The second thorn stabs a first insulation layer for the metal clip to be electrically connect to the first metal part of the main bracket.

20 Claims, 14 Drawing Sheets

LINEAR LIGHT APPARATUS

FIELD

The present invention is related to a linear light apparatus, and more particularly related to a linear light apparatus with compact design.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It is important to design light devices with low cost while easily to be assembled. Security issues are very important. Sometimes, when certain factors occur, the light device may cause serious damages like fires.

It is therefore important to consider safety design like grounding. Usually, it takes effort to particularly add a ground wire and connect the ground wire to a ground, but it needs some effort.

Therefore, it is beneficial if a better design is provided to ensure safety factors are considered while the assembling is still simple.

SUMMARY

In some embodiments, a linear light apparatus includes a light strip, a light passing cover, a main bracket, a bottom holder and a metal clip.

The light strip having an elongated substrate mounted with LED modules.

The main bracket holds the light strip for the LED modules emitting a light passing through the light passing cover.

The main bracket has a first metal part.

A first insulation layer covers at least a portion of the first metal part.

The bottom holder has two side walls for respectively attaching to two lateral walls of the main bracket.

The bottom holder has a second metal part.

A second insulation layer covers at least a portion of the second metal part.

The metal clip has a first thorn and a second thorn. The metal clip is pressed to one side wall for the first thorn to stab the second insulation layer to electrically connect the bottom holder and the metal clip.

The second thorn stabs the first insulation layer for the metal clip to be electrically connect to the first metal part of the main bracket.

In some embodiments, the metal clip is a U-shape structure with a top portion and two wings.

The two wings define a clip opening for clipping said side wall of the bottom holder.

In some embodiments, the second thorn has two second thron units protruding from the two wings toward the clip opening.

In some embodiments, the first thorn has two first thorn units protruding over the top portion of the U-shape structure toward the main bracket.

In some embodiments, a positioning hole is placed on the wing of the U-shape structure.

In some embodiments, a ground wire is fixed to the positioning hole.

In some embodiments, the first thorn and the second thorn have sharp edges to remove the second insulation layer and the first insulation layer.

In some embodiments, the first thorn is defomred when stabbing to the main bracket.

In some embodiments, a ground path is connected to the metal clip for connecting to a ground.

In some embodiments, the main bracket has a ladder groove between the two lateral walls.

The ladder groove has a central surface and two tilt surfaces.

The two tilt surfaces respected extends from top edges of the two lateral walls to lower the central surface.

The central surface is used for mounting the light strip.

In some embodiments, the two tilt surfaces define a spreading angle with respect to the central surface.

The spreading angle is larger than a main light angle of the light strip.

In some embodiments, the tilt surfaces have reflective layers facing to the light strip.

In some embodiments, a driver is placed between the bottom holder and the main bracket.

In some embodiments, the metal clip is not electrically connected to the driver.

In some embodiments, the linear light apparatus may also include two end covers on two sides of the main bracket.

The two end covers are respectively clipped between block plates of the bottom holder and the main bracket.

In some embodiments, the block plate has a socket for connecting to a power source and a ground.

The metal clip is electrically connected to the ground via the socket.

In some embodiments, the main bracket is formed completely by the first metal part and the first insulation layer.

In some embodiments, the bottom holder is formed completely by the second metal part and the second insulation layer.

In some embodiments, the metal clip is clipped by the side wall of the bottom holder and the lateral wall of the main bracket.

In some embodiments, the side wall has a first buckle unit and the lateral wall has a second buckle unit.

The main bracket and the bottom holder are attached by buckling the first buckle unit to the second buckle unit.

When the first buckle unit and the second buckle unit are buckled, the second thorn stabs the main bracket.

DETAILED DESCRIPTION

Figure 14:
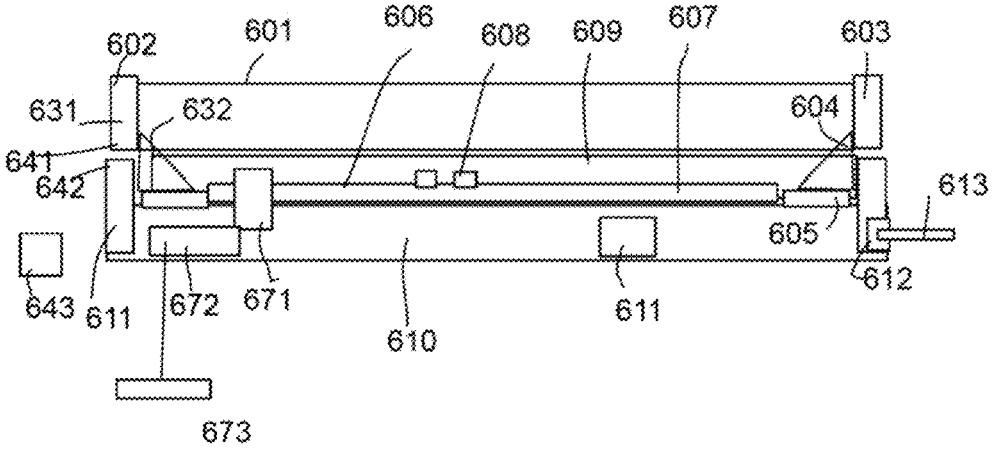
FIG. 14 shows another embodiment of a linear light apparatus.
Figure 15:
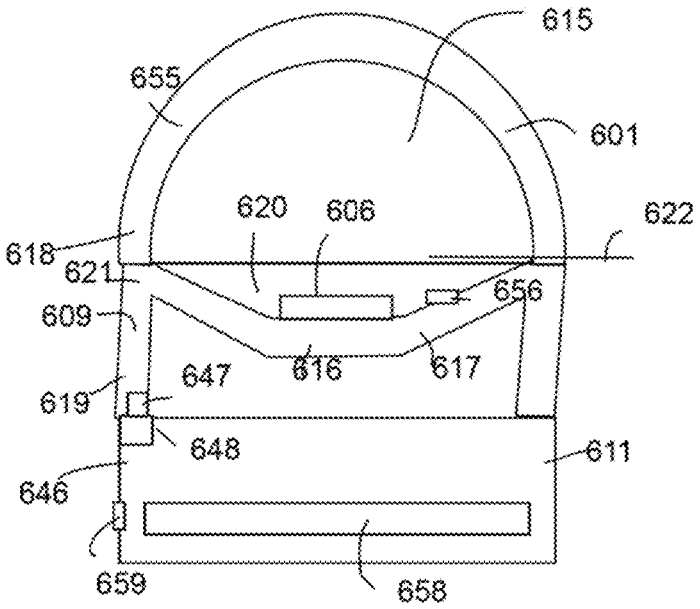
FIG. 15 shows another view of the example in FIG. 14.

Please refer to FIG. 14 and FIG. 15, which illustrates an embodiment in two views. The same reference numerals among drawings refer to the same components and would not be repeated again for brevity.

In FIG. 14, a linear light apparatus includes a light strip 606, a main bracket 609, two end covers 602 and a bottom holder 610.

The light strip 606 has an elongated substrate 607 mounted with LED modules 608.

The light passing cover 601 has two side arc openings 615 and two lateral bottom edges 618.

The two lateral bottom edges 618 of the light passing cover 601 are respectively attached to two lateral walls 619 of the main bracket 609.

The ladder groove 620 has a central surface 616 and two tilt surfaces 617.

The two tilt surfaces 617 respectively extend from top edges 621 of the two lateral walls 619 to lower the central surface 616 below a bottom line 622 of the side arc opening 615.

The central surface 616 is used for mounting the light strip 606.

The two end covers 602 respectively have a top part 631 and a bottom part 632.

The top parts 631 of the two end covers respectively cover the arc openings 615 of the light passing cover 601. The bottom parts 632 of the two end covers 602 respectively cover the lateral groove 620.

The bottom holder 610 is attached to the two lateral walls 619 of the main bracket 609.

The bottom holder 610 has two block plates 611 on two opposite sides of the bottom holder 610.

The bottom part 632 of the end cover 602 is kept between the block plate 611 and the main bracket 609.

In some embodiments, the light strip is inserted to the central surface of the main bracket via the track of the main bracket.

In some embodiments, a top edge 642 of the block plate 611 engages a bottom edge 641 of the top part 631 of the end cover 602.

In some embodiments, one block plate has a socket 612 for connecting to an external power source 613.

In some embodiments, another socket of the other block cover is used for inserting an extension module 643. The extension module 643 has a circuit, e.g. a wireless circuit, for extending a function of a driver 611 providing a driving current of the light strip 606.

Figure 9:
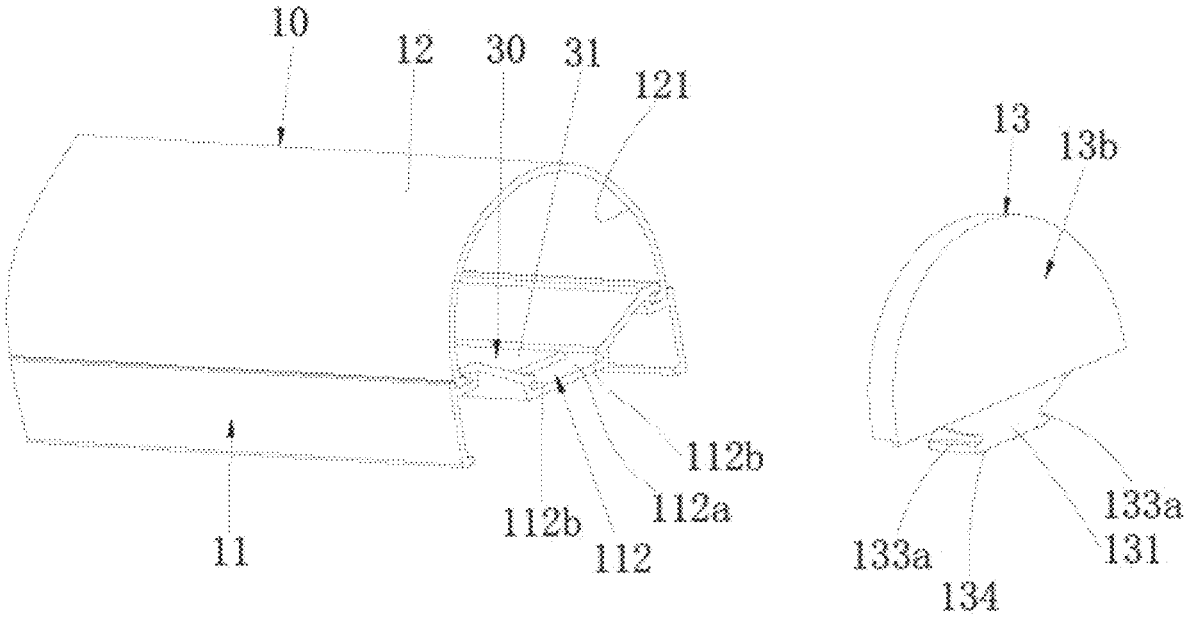
FIG. 9 illustrates another exploded view of components.

In some embodiments, the block plate only engages the bottom part of the end cover, not engages the top part of the end cover, as illustrated in FIG. 9.

Figure 10:
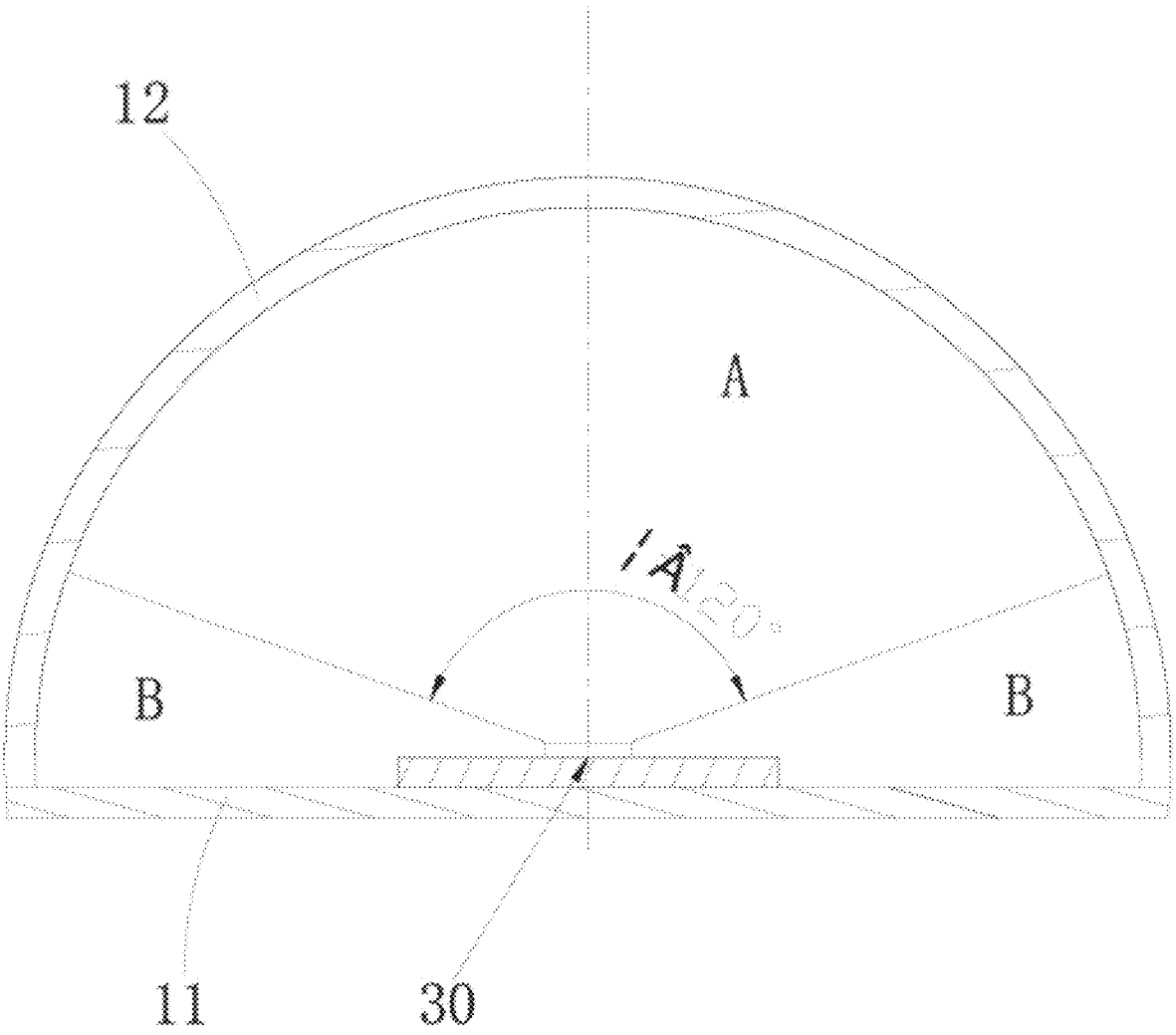
FIG. 10 illustrates a main light angle of a light strip in a first structure.

In FIG. 9 and FIG. 10, the bottom holder has two side walls 646.

The side wall 646 has a first buckle unit 648 for attaching to a second buckle unit 647 of the lateral wall 619 of the main bracket 609.

In some embodiments, the main bracket 609 is made by bending a metal plate.

In some embodiments, the second buckle unit is a bent edge of the metal plate.

In FIG. 10, the art edge 655 defines the arc opening 615.

In some embodiments, the linear light apparatus may also include a driver disposed in a driver space enclosed by the main bracket and the bottom holder.

In some embodiments, the block plate is a made by folding an edge part of the bottom holder.

In some embodiments, the tilt surfaces have reflective layers for reflecting a light of the light strip to the light passing cover. For example, a reflective film or painting may be applied or attached on the tilt surfaces.

In FIG. 10, the tilt surfaces are mounted with an additional light source 656.

The additional light source has a different optical parameter from the LED modules on the light strip.

In some embodiments, the bottom holder has an air flow channel 658 for heat dissipation, e.g. to carry heated air to an air passage 659.

In some embodiments, a linear light apparatus includes a light strip, a light passing cover, a main bracket and a bottom holder. In addition, the linear light apparatus further has a metal clip.

The light strip having an elongated substrate mounted with LED modules.

The main bracket holds the light strip for the LED modules emitting a light passing through the light passing cover.

The main bracket has a first metal part. For example, the main bracket is mainly made of metal, forming the first metal part. Some components may be added to the main bracket in other embodiments.

A first insulation layer covers at least a portion of the first metal part. The first insulation layer is used for preventing unnecessary electrical contact among components. The first insulation layer may cover all or only a partial area of the main bracket.

The bottom holder has two side walls for respectively attaching to two lateral walls of the main bracket.

The bottom holder has a second metal part. For example, the bottom holder is mainly made of metal, forming the second metal part. Some components may be added to the bottom holder in other embodiments.

A second insulation layer covers at least a portion of the second metal part. The first insulation layer is used for preventing unnecessary electrical contact among components. The first insulation layer may cover all or only a partial area of the bottom holder.

Figure 4A:
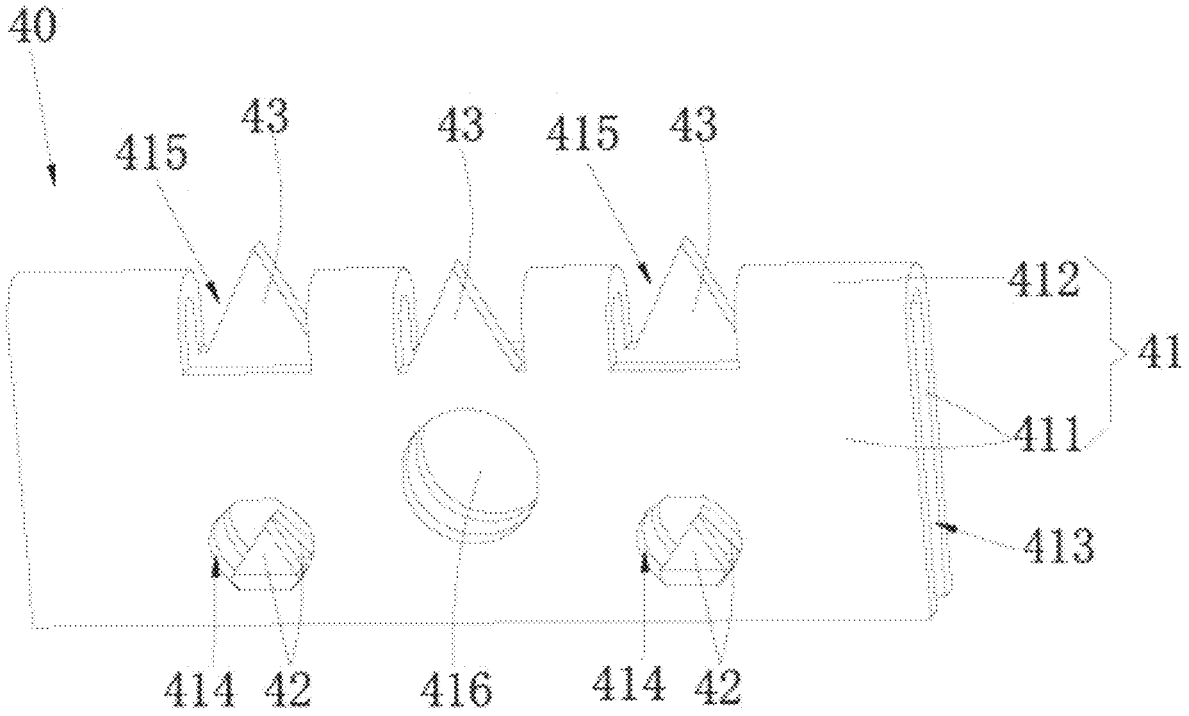
FIG. 4A illustrates a first view of the metal clip example.

FIG. 4A shows an example of a metal clip. The metal clip has a first thorn 52 and a second thorn 53. The metal clip is pressed to one side wall for the first thorn to stab the second insulation layer to electrically connect the bottom holder and the metal clip.

Figure 7:
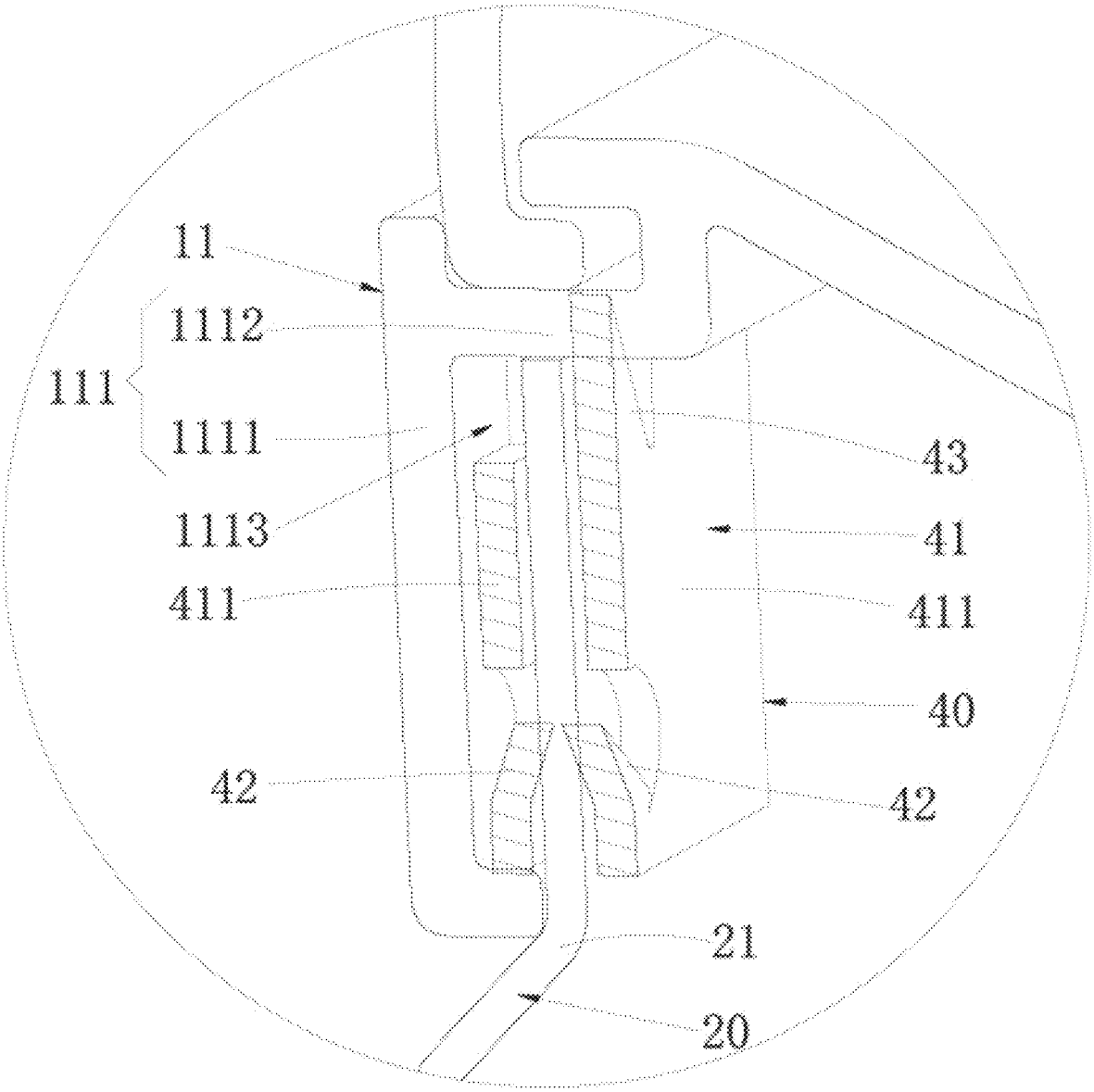
FIG. 7 illustrates a cross-sectional view of the metal clip and other components.

FIG. 7 shows an example of such design. The first thorn 42 stabs a second insulation layer on a side wall 21. The second insulation layer is a layer covering the side wall of the bottom holder at least at the stabbing position of the first thorn 42 in FIG. 7. When the first thorn stabs the bottom holder, there is an electrical connection between the bottom holder and the metal clip.

The second thorn 43 stabs the first insulation layer of the main bracket in FIG. 7. The first insulation layer is a layer for prevent electricity connection applied on a surface of the main bracket, e.g. at the stabbing position of the second thorn 43 shown in FIG. 7. The second thorn 47 stabs the first insulation layer and thus making the metal clip electrically connected to the main bracket.

The second thorn stabs the first insulation layer for the metal clip to be electrically connect to the first metal part of the main bracket.

The metal clip is therefore a good medium for electrically connecting the first metal part of the main bracket and the second metal part of the bottom holder, for further connecting undesired electricity to ground for safety concern.

Figure 4B:
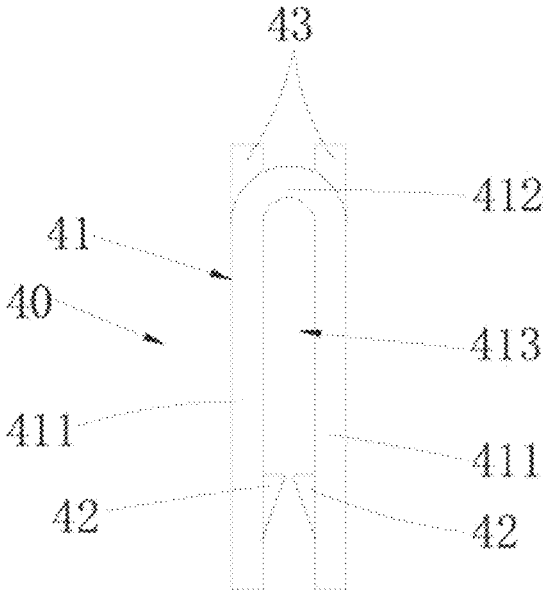
FIG. 4B illustrates a side view of the metal clip example.

In FIG. 4B, the metal clip is a U-shape structure with a top portion 412 and two wings 411.

The two wings 411 define a clip opening 413 for clipping said side wall of the bottom holder, as shown in FIG. 7.

In FIG. 4B, the second thorn 42 has two second thron units protruding from the two wings toward the clip opening 413.

In FIG. 4B, the first thorn 43 has two first thorn units protruding over the top portion 412 of the U-shape structure toward the main bracket, as shown in FIG. 7.

In FIG. 4A, a positioning hole 416 is placed on the wing of the U-shape structure.

In some embodiments, a ground wire is fixed to the positioning hole. For example, a ground wire is connected to the bolt 44 in FIG. 6 that fills the positioning hole.

In some embodiments, the first thorn and the second thorn have sharp edges to remove the second insulation layer and the first insulation layer, as shown in FIG. 4A and FIG. 4B.

In some embodiments, the first thorn is defomred when stabbing to the main bracket, as shown in FIG. 7.

In FIG. 14, a ground path 672 is connected to the metal clip 671 for connecting to a ground 673.

In some embodiments, the main bracket has a ladder groove between the two lateral walls, as shown in FIG. 14 and FIG. 15.

The ladder groove has a central surface and two tilt surfaces.

The two tilt surfaces respected extends from top edges of the two lateral walls to lower the central surface.

The central surface is used for mounting the light strip.

In some embodiments, the two tilt surfaces define a spreading angle with respect to the central surface.

The spreading angle is smaller than a main light angle of the light strip.

Please refer to FIG. 10. In FIG. 10, the light strip placed on a horizontal platform 11 has LED modules 30 emitting a light with a main angle about 120 degrees, e.g. a main portion like 80% of light is between the main angle. In other words, the design in FIG. 10 causes a light area A and a dark area B appearing on the light passing cover 12.

Figure 11:
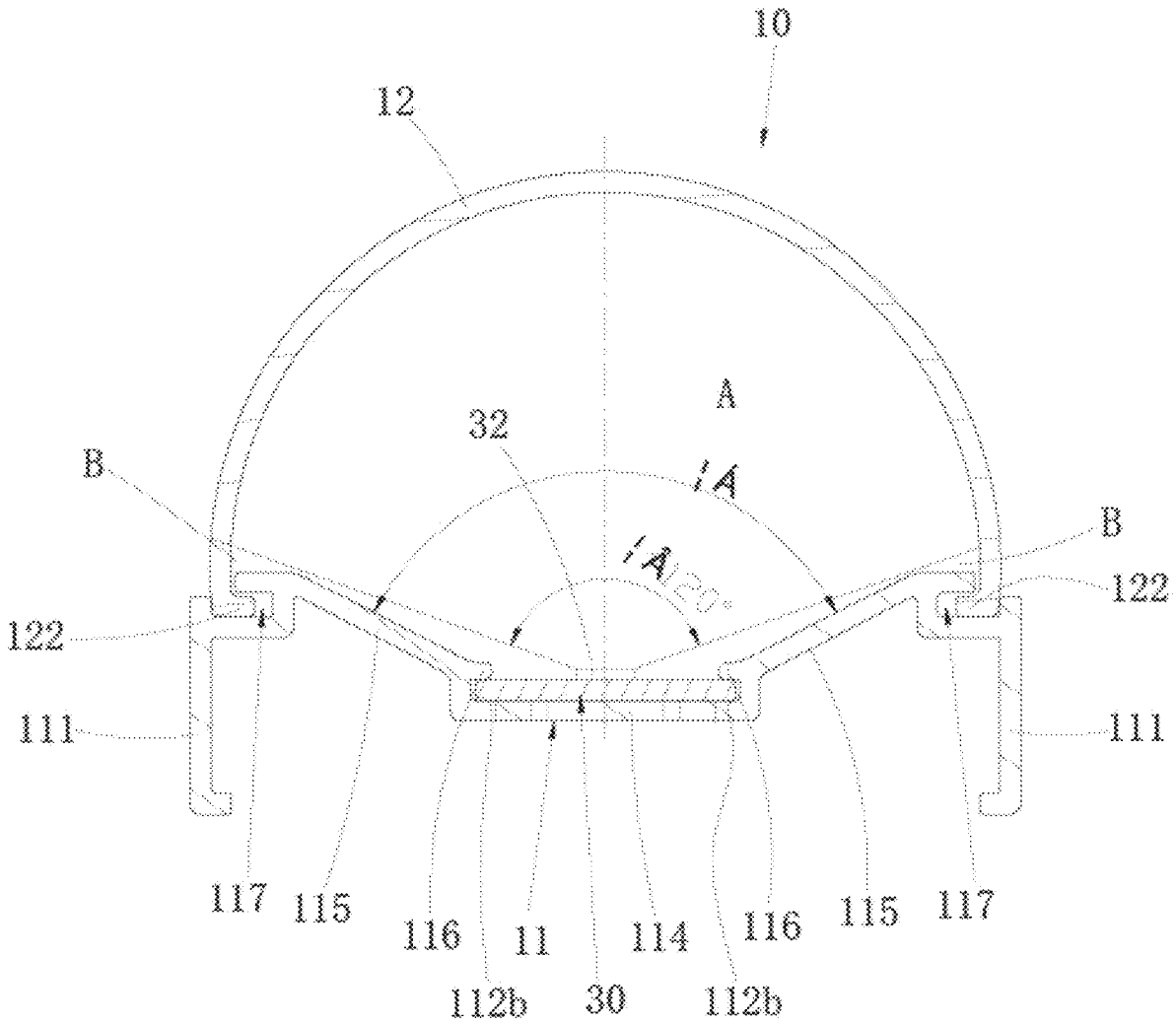
FIG. 11 illustrates a main light angle of a light strip in another structure.

Please refer to FIG. 11, which shows a ladder groove for holding the light strip.

In FIG. 11, the ladder groove has a central surface 114 for holding the light strip 30. Two tilt surfaces 115 are placed on two sides of the central surface 114, forming a smaller spreading angle, the outer angle illustrated in FIG. 15, than the main light angle, the inner angle illustrated in FIG. 15, of the LED module of the light strip.

In some embodiments, the tilt surfaces have reflective layers facing to the light strip.

In some embodiments, a driver is placed between the bottom holder and the main bracket.

In some embodiments, the metal clip is not electrically connected to the driver.

In some embodiments, the linear light apparatus may also include two end covers on two sides of the main bracket.

The two end covers are respectively clipped between block plates of the bottom holder and the main bracket.

In some embodiments, the block plate has a socket for connecting to a power source and a ground.

The metal clip is electrically connected to the ground via the socket.

In some embodiments, the main bracket is formed completely by the first metal part and the first insulation layer.

In some embodiments, the bottom holder is formed completely by the second metal part and the second insulation layer.

In some embodiments, the metal clip is clipped by the side wall of the bottom holder and the lateral wall of the main bracket.

In some embodiments, the side wall has a first buckle unit and the lateral wall has a second buckle unit.

The main bracket and the bottom holder are attached by buckling the first buckle unit to the second buckle unit.

When the first buckle unit and the second buckle unit are buckled, the second thorn stabs the main bracket.

Figure 1:
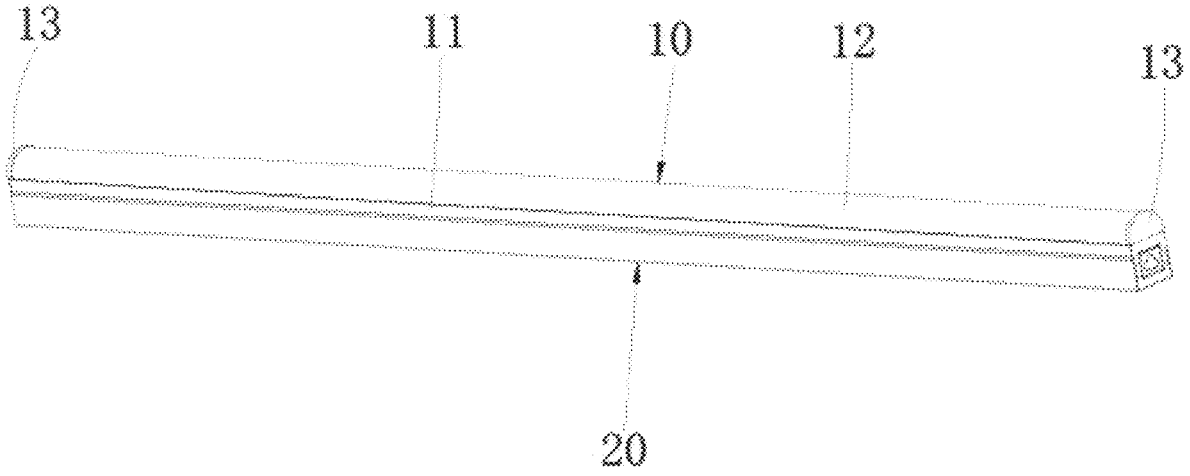
FIG. 1 illustrates an embodiment of a linear light apparatus.
Figure 2:
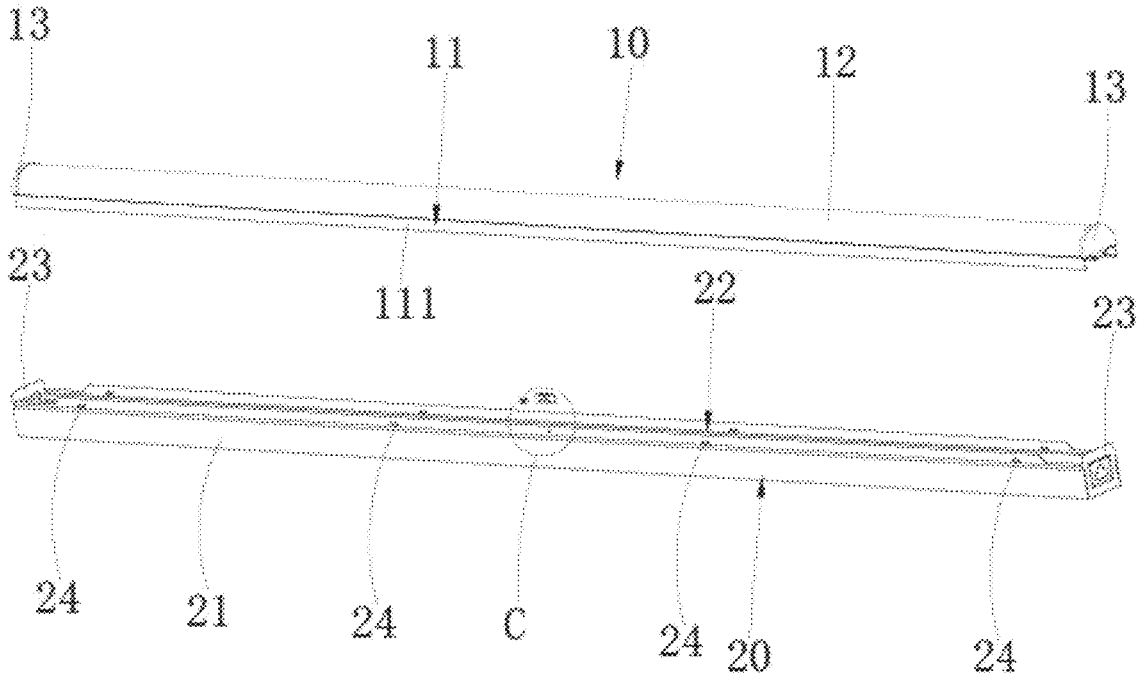
FIG. 2 illustrates an exploded view of the embodiment in FIG. 1.

Please refer to FIG. 1 to FIG. 2, which illustrates another detailed example. The same reference numerals refer to the same components among drawings.

In FIG. 1, the linear light apparatus 10 has a main bracket 11, a bottom holder 20, end covers 13, a light passing cover 12.

FIG. 2 shows an exploded view of the example in FIG. 1. In addition to the components mentioned above, the bottom holder 20 has multiple first buckle units 24. The bottom holder 20 has two block plates 23 on two opposite sides.

Figure 3:
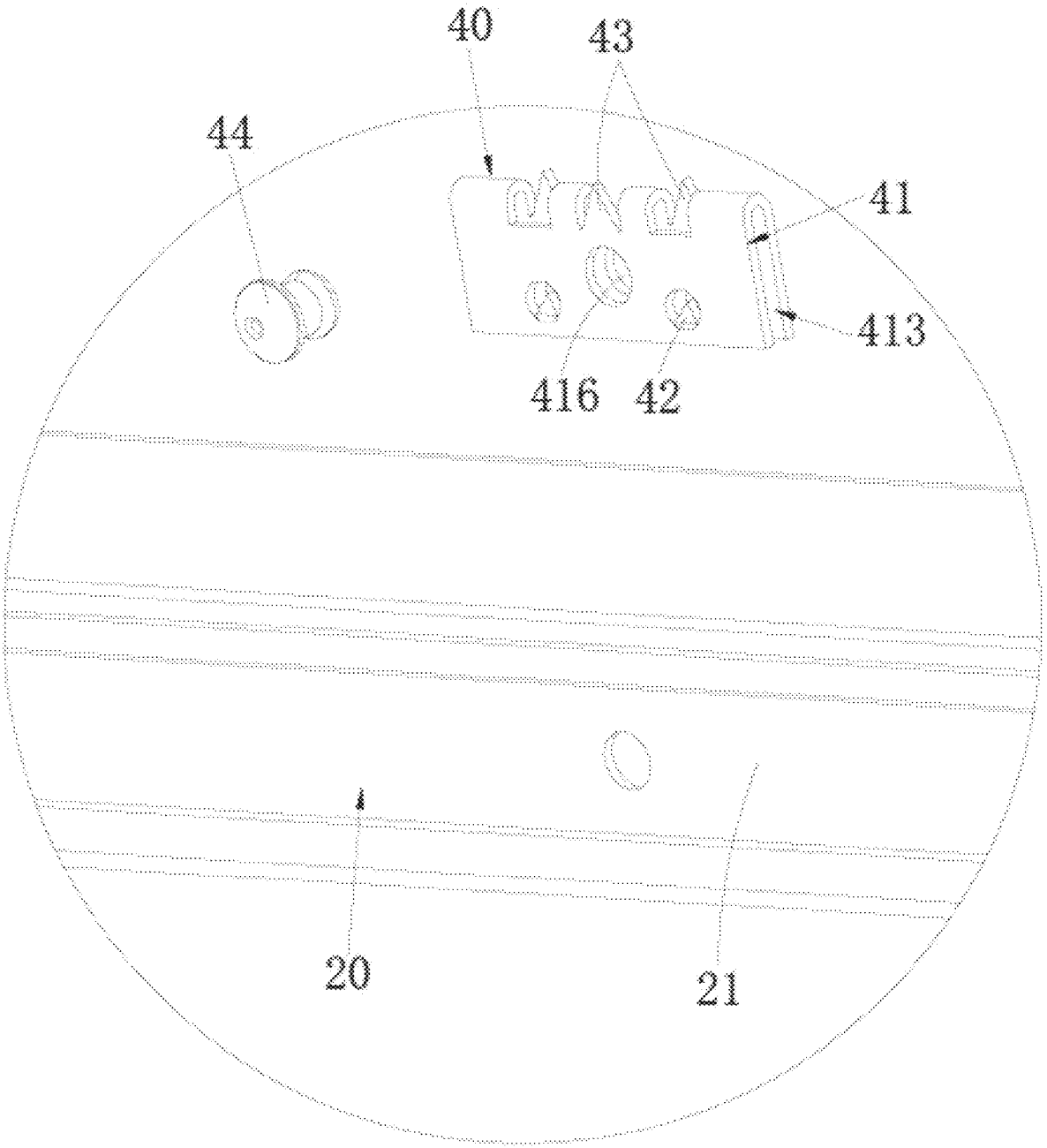
FIG. 3 illustrates a metal clip example.

FIG. 3 shows metal clip 40 with a first thorn 42 and a second thorn 43. There is a positioning hole 416 for ensuring the metal clip 40 attaching to a required position of a side wall 21 of the bottom holder 20. There is a clip opening 413 for clipping the side wall 21. The metal clip 40 is made as a metal unit 41 for fixing a screw or a rivet 44 to guide undesired electricity to ground.

FIG. 4A and FIG. 4B show two views of the metal clip.

Figure 5:
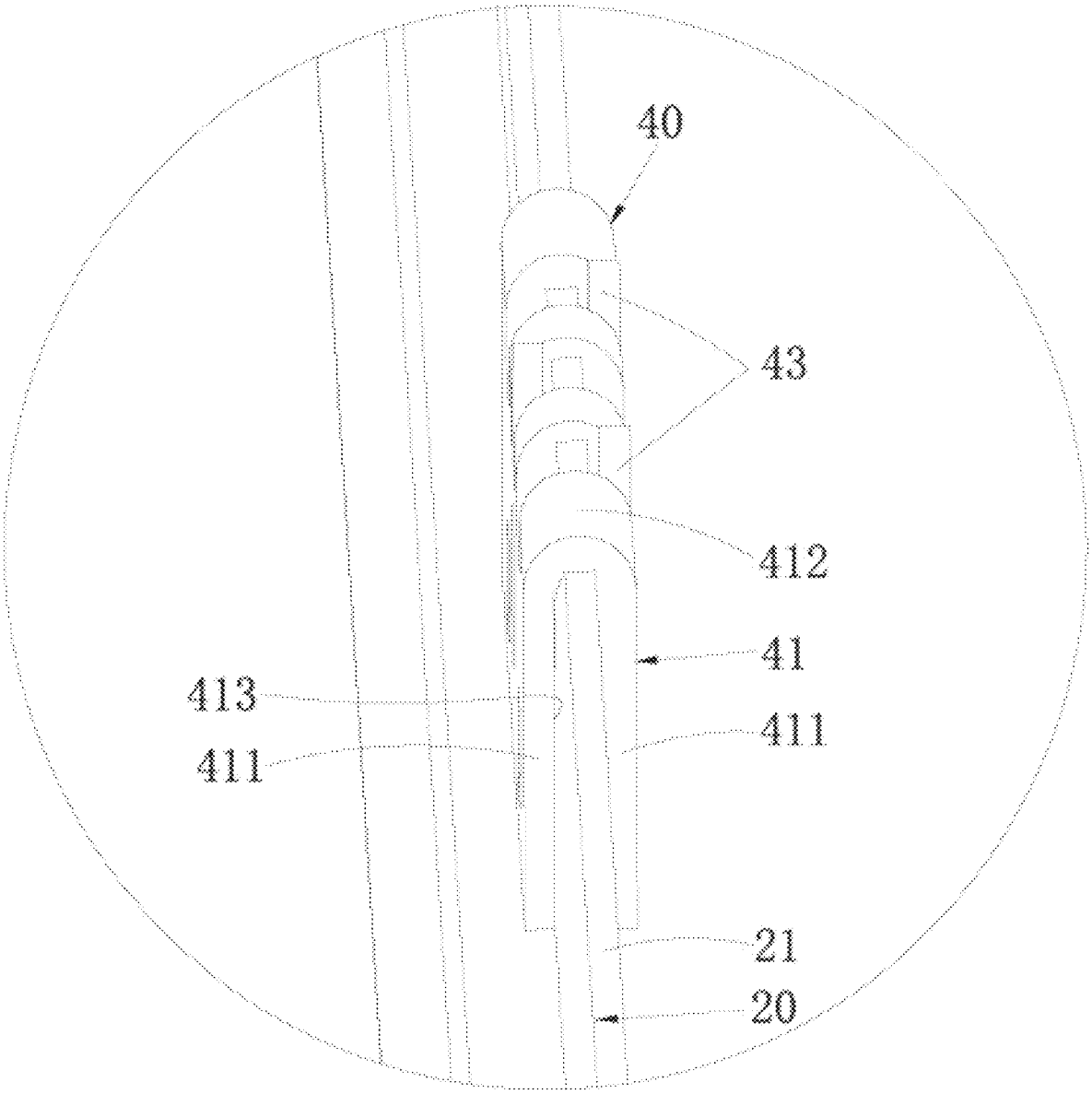
FIG. 5 illustrates the metal clip clipping the side wall.

FIG. 5 shows how the metal clip is placed on a side wall 21 of the bottom holder 20.

Figure 6:
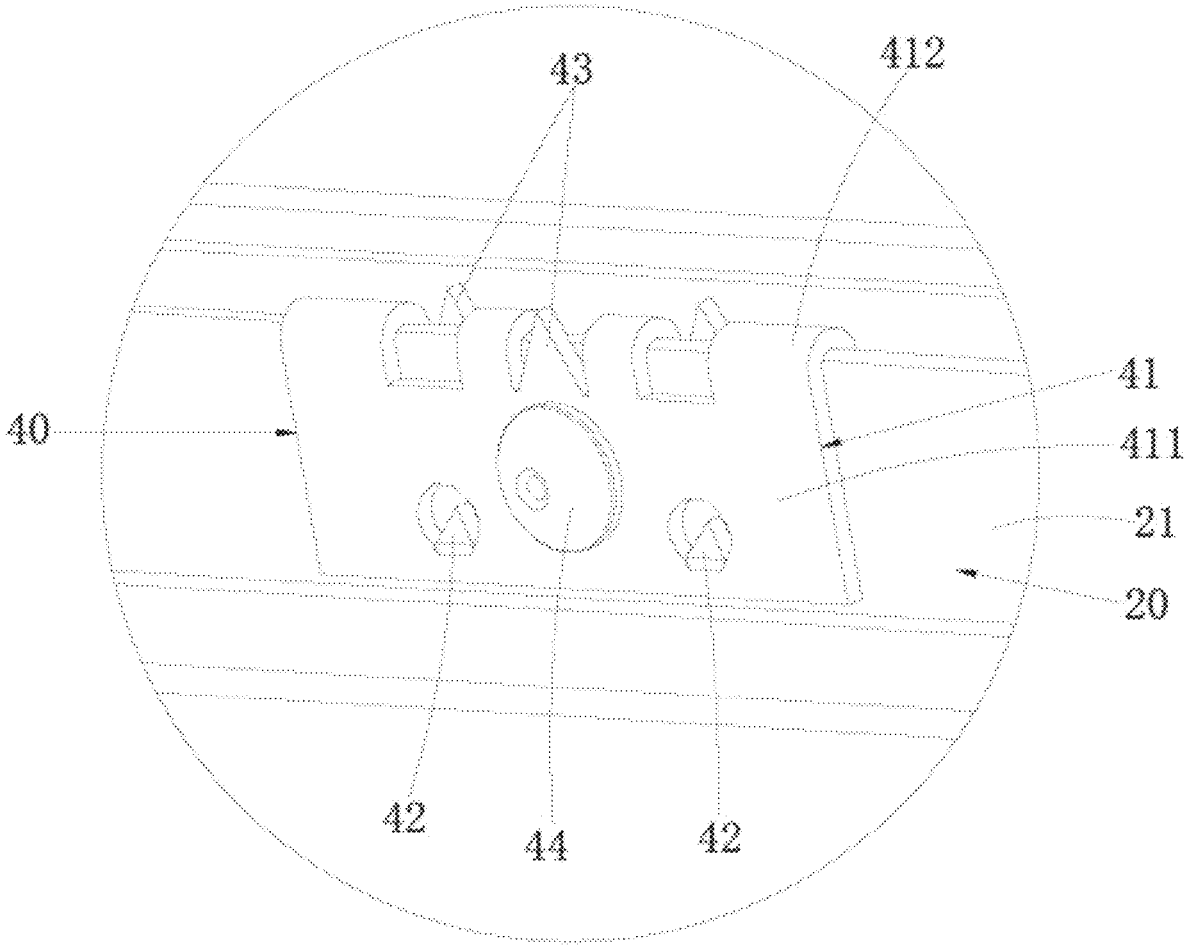
FIG. 6 illustrates another view of the example in FIG. 5.

FIG. 6 shows another zoom-up view of the connection between the metal clip 40 and the side wall 21 of the bottom holder 20.

FIG. 7 shows stabbing relation of the first thorn 42 and the second thorn 43 when the main bracket 11 is attached to the bottom holder 20.

Figure 8:
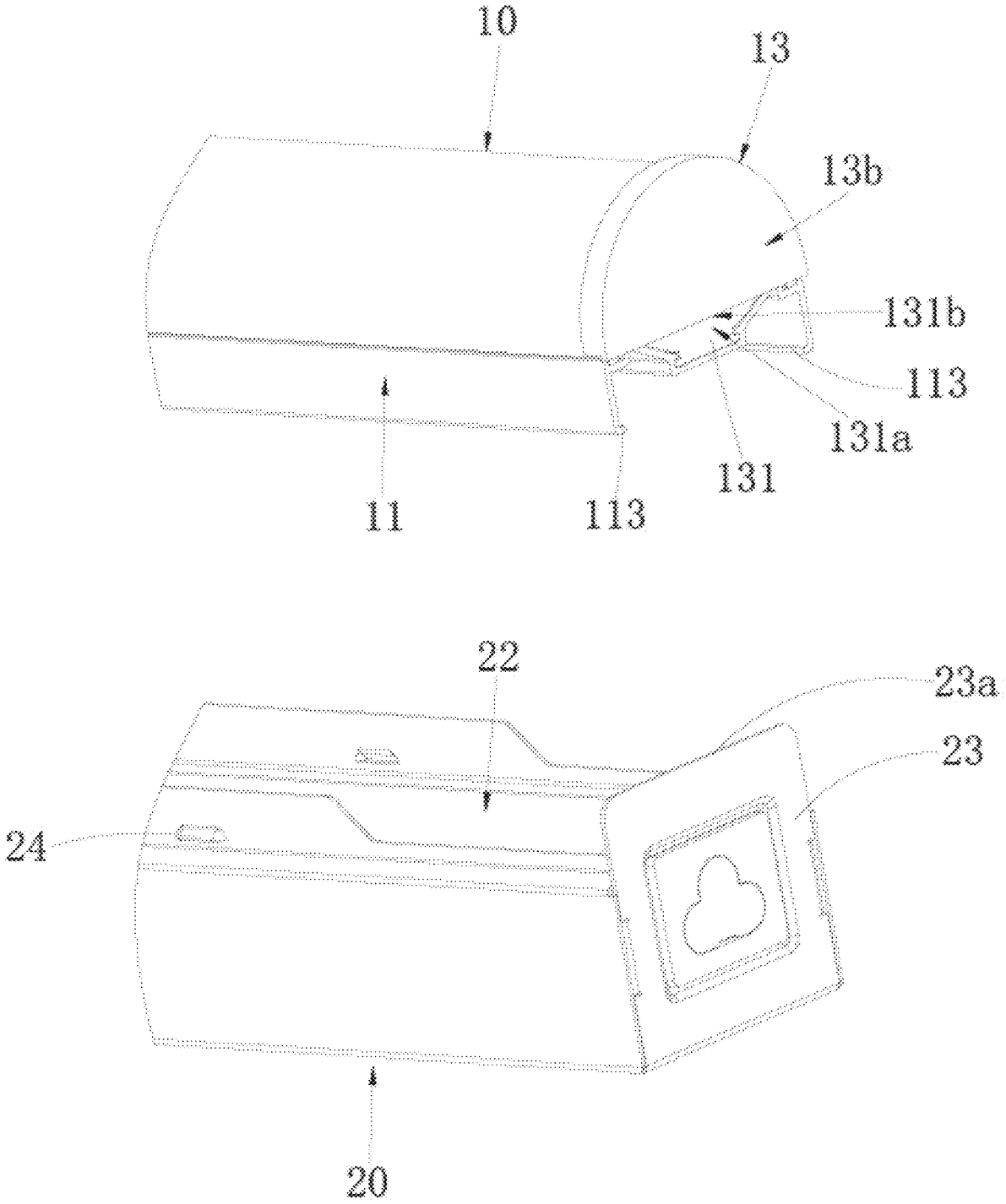
FIG. 8 illustrates an exploded view of components.

FIG. 8 show block plate 23, the end cover 13 and other components to be assembled as a two-part assembly.

FIG. 9 shows the end cover 13 has a corresponding structure for fitting and enclosing the ladder groove mentioned above.

Figure 12:
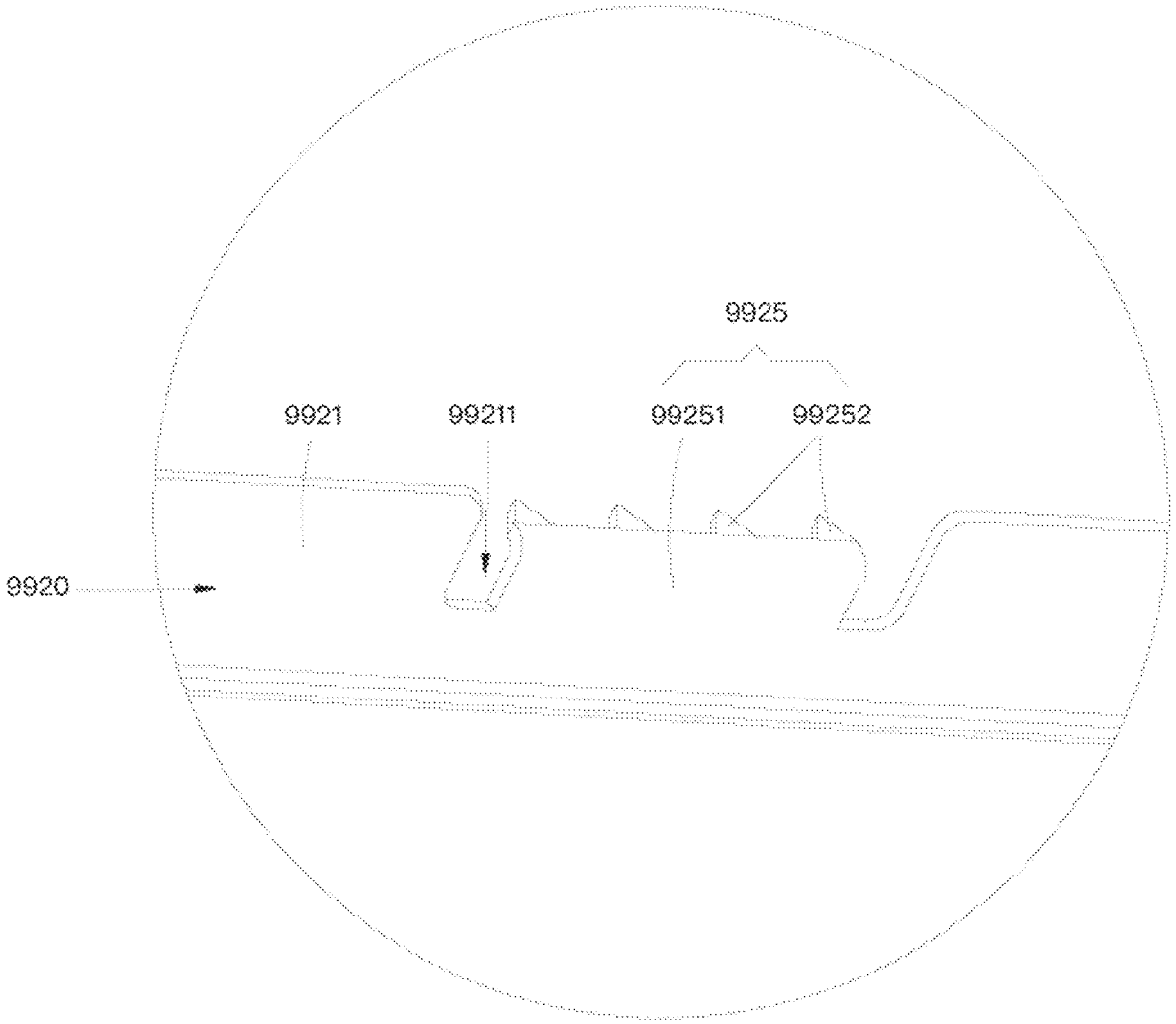
FIG. 12 illustrates another metal clip example.

FIG. 12 shows another metal clip embodiment. In FIG. 12, the metal clip 9920 has a main part 9921 and grooves 99211. The thorn unit 99252 is formed on a curved surface 99251 forming a thorn 9925.

Figure 13:
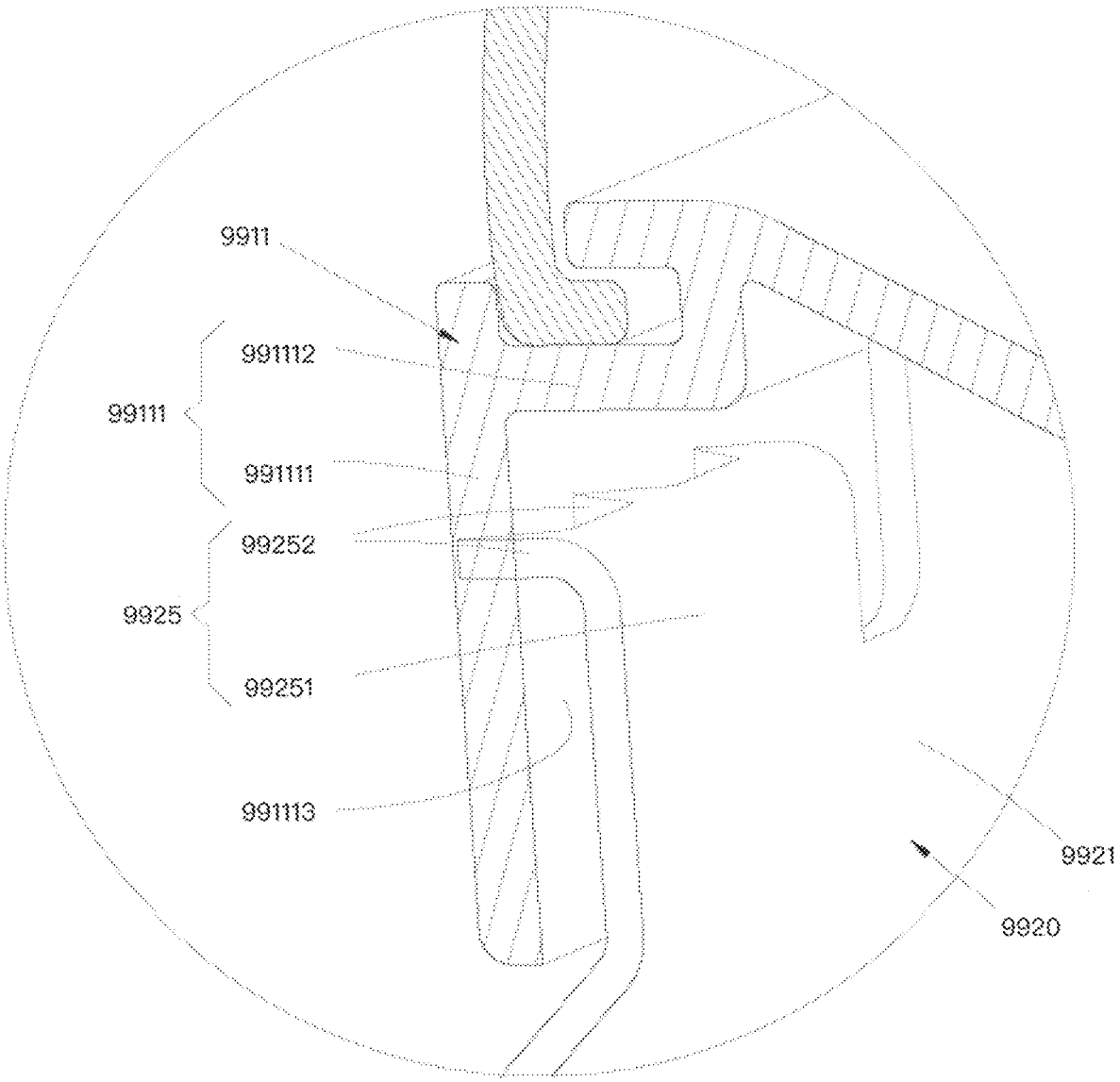
FIG. 13 illustrates another metal clip example.

FIG. 13 shows such thorn 9925 to stab a lateral wall 99111 of a main bracket 9911. In this example, the metal clip is formed directly on the side wall of the bottom holder, which is illustrated in FIG. 13.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A linear light apparatus, comprising:

a light strip having an elongated substrate mounted with LED modules;

a light passing cover;

a main bracket, wherein the main bracket holds the light strip for the LED modules emitting a light passing through the light passing cover, the main bracket has a first metal part, a first insulation layer covers at least a portion of the first metal part;

a bottom holder, wherein the bottom holder has two side walls for respectively attaching to two lateral walls of the main bracket, the bottom holder has a second metal part, a second insulation layer covers at least a portion of the second metal part; and a metal clip having a first thorn and a second thorn, wherein the metal clip is pressed to one side wall for the first thorn to stab the second insulation layer to electrically connect the bottom holder and the metal clip, the second thorn stabs the first insulation layer for the metal clip to be electrically connect to the first metal part of the main bracket.

2. The linear light apparatus of claim 1, wherein the metal clip is a U-shape structure with a top portion and two wings, wherein the two wings define a clip opening for clipping said side wall of the bottom holder.

3. The linear light apparatus of claim 2, wherein the second thorn has two second thron units protruding from the two wings toward the clip opening.

4. The linear light apparatus of claim 2, wherein the first thorn has two first thorn units protruding over the top portion of the U-shape structure toward the main bracket.

5. The linear light apparatus of claim 2, wherein a positioning hole is placed on the wing of the U-shape structure.

6. The linear light apparatus of claim 5, wherein a ground wire is fixed to the positioning hole.

7. The linear light apparatus of claim 2, wherein the first thorn and the second thorn have sharp edges to remove the second insulation layer and the first insulation layer.

8. The linear light apparatus of claim 2, wherein the first thorn is defomred when stabbing to the main bracket.

9. The linear light apparatus of claim 1, wherein a ground path is connected to the metal clip for connecting to a ground.

10. The linear light apparatus of claim 1, wherein the main bracket has a ladder groove between the two lateral walls, the ladder groove has a central surface and two tilt surfaces, the two tilt surfaces respected extends from top edges of the two lateral walls to lower the central surface, the central surface is used for mounting the light strip.

11. The linear light apparatus of claim 10, wherein the two tilt surfaces define a spreading angle with respect to the central surface, the spreading angle is smaller than a main light angle of the light strip.

12. The linear light apparatus of claim 10, wherein the tilt surfaces have reflective layers facing to the light strip.

13. The linear light apparatus of claim 1, wherein a driver is placed between the bottom holder and the main bracket.

14. The linear light apparatus of claim 13, wherein the metal clip is not electrically connected to the driver.

15. The linear light apparatus of claim 1, further comprising two end covers on two sides of the main bracket, the two end covers are respectively clipped between block plates of the bottom holder and the main bracket.

16. The linear light apparatus of claim 15, wherein the block plate has a socket for connecting to a power source and a ground, the metal clip is electrically connected to the ground via the socket.

17. The linear light apparatus of claim 1, wherein the main bracket is formed completely by the first metal part and the first insulation layer.

18. The linear light apparatus of claim 1, wherein the bottom holder is formed completely by the second metal part and the second insulation layer.

19. The linear light apparatus of claim 1, wherein the metal clip is clipped by the side wall of the bottom holder and the lateral wall of the main bracket.

20. The linear light apparatus of claim 1, wherein the side wall has a first buckle unit and the lateral wall has a second buckle unit, the main bracket and the bottom holder are attached by buckling the first buckle unit to the second buckle unit, when the first buckle unit and the second buckle unit are buckled, the second thorn stabs the main bracket.

* * * * *